US006604910B1

(12) United States Patent
Zupanick

(10) Patent No.: US 6,604,910 B1
(45) Date of Patent: Aug. 12, 2003

(54) FLUID CONTROLLED PUMPING SYSTEM AND METHOD

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 0 days.

(21) Appl. No.: 09/841,773

(22) Filed: Apr. 24, 2001

(51) Int. Cl.[7] ..... F04B 49/00

(52) U.S. Cl. ..... 417/36; 417/85; 417/118; 417/126

(58) Field of Search ..... 417/85, 118, 120, 417/126; 418/48; 166/105, 68, 68.5

(56) References Cited

U.S. PATENT DOCUMENTS

| | | | | |
|---|---|---|---|---|
| 1,398,550 A | | 11/1921 | Halvorsen | |
| 1,462,159 A | * | 7/1923 | Aikman | 417/85 |
| 1,521,570 A | * | 12/1924 | Wineman | 417/85 |
| 2,257,523 A | | 9/1941 | Combs | |
| 2,924,180 A | | 2/1960 | Bourke et al. | |
| 3,016,833 A | * | 1/1962 | Creed | 417/85 |
| 3,203,350 A | | 8/1965 | Chang | |
| 3,227,326 A | | 1/1966 | Beamer | |
| 3,324,803 A | * | 6/1967 | Kelley et al. | 417/126 |
| 3,342,135 A | * | 9/1967 | Schnabel, Jr. | 417/85 |
| 3,453,962 A | | 7/1969 | Strader | |
| 3,512,904 A | | 5/1970 | Allen | |
| 3,677,665 A | | 7/1972 | Corkhill | |
| 4,050,854 A | * | 9/1977 | Hereford et al. | 417/126 |
| 4,080,115 A | | 3/1978 | Sims et al. | |
| 4,125,163 A | | 11/1978 | Fitzpatrick | |
| 4,173,255 A | | 11/1979 | Kramer | |
| 4,600,368 A | | 7/1986 | Sommer | |
| 4,614,232 A | | 9/1986 | Jiirgens et al. | |
| 4,718,824 A | | 1/1988 | Cholet et al. | |
| 4,901,798 A | * | 2/1990 | Amani | 417/120 |
| 4,961,689 A | * | 10/1990 | Avramidis | 417/118 |
| 5,097,902 A | | 3/1992 | Clark | |
| 5,156,177 A | | 10/1992 | Bishoff | |
| 5,183,391 A | * | 2/1993 | Fiedler | 417/118 |
| 5,310,020 A | * | 5/1994 | Martin et al. | 184/6.3 |
| 5,339,905 A | * | 8/1994 | Dowker | 166/324 |
| 5,447,416 A | | 9/1995 | Wittrisch | 417/442 |
| 5,488,993 A | * | 2/1996 | Hershberger | 166/372 |
| 5,603,608 A | | 2/1997 | Marz | |
| 5,611,397 A | * | 3/1997 | Wood | 166/105 |
| 5,688,114 A | | 11/1997 | Millington et al. | |
| 5,722,820 A | | 3/1998 | Wild et al. | |
| 5,772,403 A | * | 6/1998 | Allison et al. | 417/44.2 |
| 5,779,460 A | | 7/1998 | Marz | |
| 5,782,608 A | | 7/1998 | McKee | |
| 5,921,350 A | * | 7/1999 | Tsai | 184/6.28 |
| 5,941,305 A | | 8/1999 | Thrasher et al. | |
| 5,988,992 A | | 11/1999 | Tetzlaff et al. | |
| 5,996,691 A | * | 12/1999 | Norris et al. | 166/68.5 |
| 6,039,546 A | | 3/2000 | Edwards et al. | |
| 6,048,175 A | * | 4/2000 | Corlew et al. | 417/120 |
| 6,120,267 A | | 9/2000 | Cunningham | |
| 6,123,149 A | | 9/2000 | McKinzie et al. | |
| 6,138,750 A | * | 10/2000 | Ford | 417/38 |
| 6,224,343 B1 | * | 5/2001 | Newcomer | 417/118 |

FOREIGN PATENT DOCUMENTS

EP 0 561 494 A2 3/1993

OTHER PUBLICATIONS

Bottomhole Pressure Sensor for PCP; World Oil; p. 78, Mar., 2001.

* cited by examiner

*Primary Examiner*—Cheryl J. Tyler
(74) *Attorney, Agent, or Firm*—Baker Botts L.L.P.

(57) ABSTRACT

A fluid controlled pumping system includes a pumping unit disposed within a fluid cavity. The pumping unit includes a passage extending to a suction end of the pumping unit. The system also includes a pressure source coupled to the passage and operable to force a fluid outwardly from the passage proximate to the suction end of the pumping unit. The system includes a pressure sensor coupled to the passage and operable to determine a fluid pressure within the passage. The system further includes a controller coupled to the pumping unit and operable to regulate an operating parameter of the pumping unit using the fluid pressure.

35 Claims, 4 Drawing Sheets

FLUID CONTROLLED PUMPING SYSTEM AND METHOD

TECHNICAL FIELD OF THE INVENTION

This invention relates in general to the field of fluid pumping systems and, more particularly, to a fluid controlled pumping system and method.

BACKGROUND OF THE INVENTION

Pumping units are used in a variety of applications for compressing, raising, or transferring fluids. For example, pumping units may be used in municipal water and sewage service applications, mining and/or hydrocarbon exploration and production applications, hydraulic motor applications, and consumer product manufacturing applications. Pumping units, such as progressive cavity pumps, centrifugal pumps, and other types of pumping devices, are generally disposed within a fluid and are used to compress or increase the pressure of the fluid, raise the fluid between different elevations, or transfer the fluid between various destinations.

Conventional pumping units, however, suffer several disadvantages. For example, conventional pumping units generally require some form of lubrication to remain operational. For instance, a progressive cavity pump generally includes a rotor disposed within a rubber stator. In operation, a rotational force is imparted to the rotor, thereby producing a corkscrew-like effect between the rotor and the stator to lift the fluid from one elevation to another. In the case of the progressive cavity pump, friction caused by the rotation of the rotor relative to the stator without fluid lubrication oftentimes causes the progressive cavity pump to fail within a relatively short period of time. Generally, the fluid that is being pumped provides the required lubrication. However, variations in the fluid level proximate to an inlet of the pumping unit may result in an absence of fluid lubrication for the pumping unit.

Thus, maintaining adequate fluid lubrication at the pumping unit is critical for the performance and longevity of pumping operations. Additionally, in centrifugal pumping applications, an absence of the fluid to be pumped may cause cavitation.

SUMMARY OF THE INVENTION

Accordingly, a need has arisen for an improved pumping system that provides increased control of fluid lubrication of the pumping unit. The present invention provides a fluid controlled pumping system and method that addresses shortcomings of prior pumping systems and methods.

According to one embodiment of the present invention, a fluid controlled pumping system includes a pumping unit disposed within a fluid cavity. The pumping unit includes a passage extending to a head of the pumping unit. The system also includes a pressure source coupled to the passage and operable to force a fluid outwardly from the head of the pumping unit through the passage. The system also includes a pressure sensor coupled to the passage and operable to determine a fluid pressure within the passage. The system further includes a controller coupled to the pumping unit and operable to regulate an operating parameter of the pumping unit in response to the fluid pressure.

According to another embodiment of the present invention, a method for fluid controlled pumping includes providing a pumping unit disposed within a fluid cavity. The pumping unit includes a passage extending to a head of the pumping unit. The method also includes forcing a fluid outwardly from the head of the pumping unit through the passage and determining a fluid pressure within the passage. The method also includes automatically regulating an operating parameter of the pumping unit in response to the fluid pressure.

The invention provides several technical advantages. For example, in one embodiment of the present invention, the system monitors the fluid pressure within the fluid cavity which corresponds to a level of the fluid within the fluid cavity. Based on the fluid pressure, the system controls the operating parameters of the pumping unit to ensure proper fluid lubrication during operation. Thus, as the fluid level decreases within the fluid cavity, the operating parameters of the pumping unit may be modified. For example, in response to a decrease in the fluid level within the fluid cavity, the operating speed of the pumping unit may also be decreased, thereby maintaining a substantially constant fluid level within the fluid cavity to provide required pumping unit lubrication. Additionally, operation of the pumping unit may also be ceased based on the fluid level within the fluid cavity to substantially prevent operation of the pumping unit absent fluid lubrication.

Another technical advantage of the present invention includes providing a flushing mechanism for substantially preventing a build-up of materials at the inlet of the pumping unit. For example, a progressive cavity pump may include an internal passage extending downwardly within a rotor of the pump and having an outlet disposed proximate to the inlet of the pump. A fluid may be provided downwardly within the passage and outwardly from the outlet of the passage to flush material accumulation build-up from the inlet of the pump and maintain material suspension within the pumped fluid if desired.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE DRAWINGS

Figure 1:
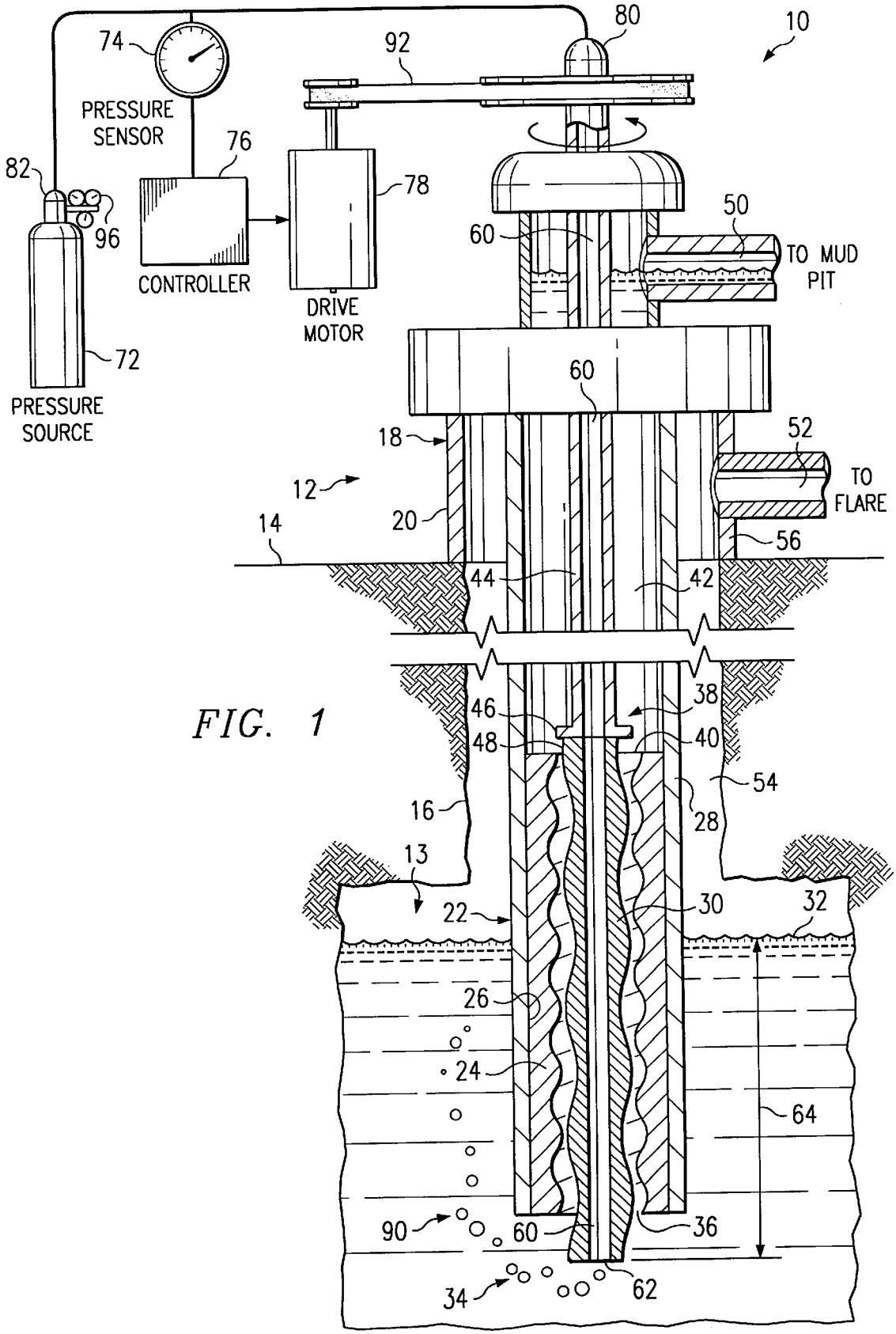
FIG. 1 is a diagram illustrating a fluid controlled pumping system in accordance with an embodiment of the present invention.

FIG. 1 is a diagram illustrating a fluid controlled pumping system 10 in accordance with an embodiment of the present invention. In the embodiment of FIG. 1, the system 10 is illustrated in a mining or hydrocarbon production application; however, it should be understood that the system 10 may also be used in other pumping applications. The system 10 includes a pumping unit 12 extending into a fluid cavity 13. The fluid cavity 13 generally includes a fluid to which a compressing, raising, or transferring operation is to be performed. Thus, in the illustrated embodiment, the pumping unit 12 extends downwardly from a surface 14 into a well bore 16. In this embodiment, pumping unit 12 comprises a progressive cavity pump 18; however, it should be understood that other types of pumping units 12 may be used incorporating the teachings of the present invention.

Pump 18 includes a base portion 20 disposed on the surface 14 and a stator/rotor portion 22 disposed within the well bore 16. Stator/rotor portion 22 includes a stator 24 coupled to an interior surface 26 of a housing 28. Stator/rotor portion 22 also includes a rotor 30 disposed within the stator 24 such that rotation of the rotor 30 relative to the stator 24 produces a corkscrew-like effect, thereby pumping or lifting a fluid 32 disposed within the cavity 13, or well bore 16, to the surface 14. It should be understood that, in this embodiment, the fluid 32 may include water, hydrocarbon compositions, drilling mud, drilling cuttings, and other substances generally lifted to the surface 14 from the well bore 16. However, the fluid 32 may comprise other substances generally encountered in the particular pumping application.

In operation, a suction end 34 of the stator/rotor portion 22 is disposed within the well bore 16 such that rotation of the rotor 30 relative to the stator 24 draws the fluid 32 upwardly through an inlet 36 formed between the rotor 30 and the stator 24. The fluid 32 travels upwardly through the stator/rotor portion 22 and exits a discharge end 38 of the stator/rotor portion 22 through an outlet 40 formed between the stator 24 and the rotor 30. The fluid 32 travels upwardly within an annulus 42 formed between the housing 28 and a drive shaft 44. A lower end 46 of the drive shaft 44 is coupled to an upper end 48 of the rotor 30 to provide rotational movement of the rotor 30 relative to the stator 24. The fluid 32 traveling upwardly through the annulus 42 is directed outwardly from annulus 42 to a mud pit or other location (not explicitly shown) through a discharge port 50. For example, the fluid 32 may be directed through discharge port 50 to a separator (not explicitly shown) for separating hydrocarbons and/or other substances from water. However, it should be understood that the fluid 32 may also be directed through discharge port 50 to other suitable processing systems.

The well bore 16 also includes a discharge port 52 for directing gas or other substances outwardly from well bore 16. For example, a gas disposed within the well bore 16 may travel upwardly through an annulus 54 formed between the housing 28 and both the well bore 16 and a housing 56 of the base portion 20. Thus, gases within the well bore 16 may be directed upwardly toward the surface 14 and discharged through port 52 to be flared or to accommodate other suitable processing requirements.

As illustrated in FIG. 1, the pumping unit 12 also includes a hollow passage 60 extending downwardly through drive shaft 44 and rotor 30. Passage 60 includes an open end 62 disposed proximate the suction end 34 of the stator/rotor portion 22 such that a depth 64 of the fluid 32 within the well bore 16 relative to the pumping unit 12 may be monitored. The use of the passage 60 will be described in greater detail below.

System 10 also includes a pneumatic pressure source 72, a pressure sensor 74, a controller 76, and a drive motor 78. Pressure source 72 is coupled to the passage 60 through an upper end 80 of the pumping unit 12 for directing a pressurized fluid downwardly within the passage 60. Pressure source 72 may include carbon dioxide, nitrogen, air, methane, or other suitable pressurized fluids. Pressure sensor 74 is also coupled to the passage 60 for measuring the fluid pressure within the passage 60.

In operation, the pressure source 72 provides a pressurized fluid downwardly within the passage 60 such that a relatively small and controlled amount or volume of the pressurized fluid exits the open end 62 of the passage 60, as indicated generally at 90. For example, the pressure source 72 may be maintained at a pressure significantly greater than a pressure of the fluid 32 within the well bore 16, and an orifice metering valve 82 may be coupled to the pressure source 72 such that the friction pressure becomes generally negligible. However, other suitable methods and devices may also be used to maintained a controlled amount or volume of the pressurized fluid exiting the open end 62 of the passage 60.

The pressure sensor 74 is used to measure the pressure within the passage 60 required to dispel the pressurized fluid from the open end 62 of the passage 60. As illustrated in FIG. 1, the pressure required to dispel the pressurized fluid outwardly from the open end 62 of the passage 60 generally corresponds to the level or depth 64 of the fluid 32 proximate the inlet 36 of the pumping unit 12. Therefore, the pressure within the passage 60 may be used to determine the depth 64 of the fluid 32 proximate the inlet 36 of the pumping unit 12.

As further illustrated in FIG. 1, the pressure sensor 74 is coupled to the controller 76. The controller 76 may comprise a processor, mini computer, workstation, or other type of processing device for receiving a signal from the pressure sensor 74 corresponding to the pressure within the passage 60. The signals received from the sensor 74 by the controller 76 may comprise a continuous data stream or may comprise periodic data signals. The controller 76 receives the signals from the sensor 74 and monitors the fluid pressure within the passage 60. Based on the pressure within the passage 60, the controller 76 regulates the operating parameters of the pumping unit 12.

For example, as illustrated in FIG. 1, the controller 76 is coupled to the drive motor 78 to control the operating parameters of the pumping unit 12. As illustrated in FIG. 1, the drive motor 78 imparts a rotational force to the drive shaft 44 via a belt 92 coupled between the drive motor 78 and the drive shaft 44 proximate the upper end 80 of the pumping unit 12 to rotate the rotor 30 relative to the stator 24. Thus, the controller 76 controls the rotational force imparted by the drive motor 78 based on the pressure signal received from the pressure sensor 74, thereby controlling the fluid 32 flow rate to the surface 14. For example, in operation, the drive motor 78 receives a control signal from the controller 76 to regulate the rotational force imparted to the drive shaft 44 by the drive motor 78.

Thus, in operation, the operating parameters of the pumping unit 12 are modified in response to changes in the amount of fluid 32 within the well bore 16 to substantially prevent operation of the pumping unit 12 in a "dry" or unlubricated condition. For example, as illustrated in FIG. 1, pressure source 72 provides a pressurized fluid downwardly within the passage 60 so that a relatively small and controlled amount or volume of the pressurized fluid exits the open end 62 of the passage 60 proximate the suction end 34. In response to a change in the depth 64 of the fluid 32 within the well bore 16, the pressure within the passage 60 required to dispel the pressurized fluid outwardly from the open end 62 of the passage 60 also varies. Based on the pressure change within the passage 60, controller 76 regulates the operating parameters of the pumping unit 12 via drive motor 78. Thus, as the depth 64 of the fluid 32 within the well bore 16 decreases, the pressure within the passage 60 required to dispel the pressurized fluid outwardly from the open end 62 also correspondingly decreases. In response to a decrease in the pressure within the passage 60, controller 76 automatically reduces the rate of rotation of the drive shaft 44 provided by the drive motor 78, thereby resulting in a decrease in the flow rate of fluid 32 removed from the well bore 16. Thus, the rate of rotation of the drive shaft 44 may be reduced or ceased in response to a decrease in the level of the fluid 32 within the well bore 16, thereby reducing the rate of fluid 32 flow upwardly out of the well bore 16 and substantially preventing the operation of the pumping unit 12 absent adequate lubrication. Additionally, by regulating the operating parameters of the pumping unit 12 based on the fluid 32 level within the well bore 16, the present invention also provides a means to maintain a substantially constant fluid 32 level within the well bore 16.

Correspondingly, system 10 may also be used to increase the rate of rotation of the drive shaft 44 in response to increases in the depth 64 of the fluid 32 in the well bore 16, thereby increasing the fluid 32 flow rate from the well bore 16. For example, as the depth 64 of the fluid 32 increases within the well bore 16, the pressure required to dispel the fluid outwardly from the open end 62 of the passage 60 also increases. In response to the increase in pressure within the passage 60, the controller 76 regulates the drive motor 78 to provide additional rotational force to the drive shaft 44, thereby providing increased pumping volume of the fluid 32 to the surface 14.

Thus, the present invention provides increased control of the pumping of fluid 32 from the well bore 16 to the surface 14 based on an amount or depth 64 of the fluid 32 within the well bore 16. As the depth 64 of the fluid 32 increases or decreases, the controller 76 regulates the operating parameters of the pumping unit 12 via the drive motor 78, thereby causing a corresponding increase or decrease, respectively, of the rotational speed of the drive shaft 44. Therefore, the present invention may be used to provide increased pumping of the fluid 32 in response to increased levels of the fluid 32 within the well bore 16 and/or a decrease or cessation of the pumping of the fluid 32 from the well bore 16 in response to decreasing amounts of fluid 32 within the well bore 16.

The present invention may also provide flushing or mixing of the fluid 32 within the fluid cavity 13 to substantially prevent or eliminate material build-up at the inlet 36 of the pumping unit 12. For example, a solenoid valve 96 or other suitable device may be used to provide periodic fluid pressure bursts downwardly through the passage 60 and outwardly proximate to the suction end 34 of the pumping unit 12 to substantially prevent material accumulation at the inlet 36 and maintain material suspension within the fluid 32.

Figure 2:
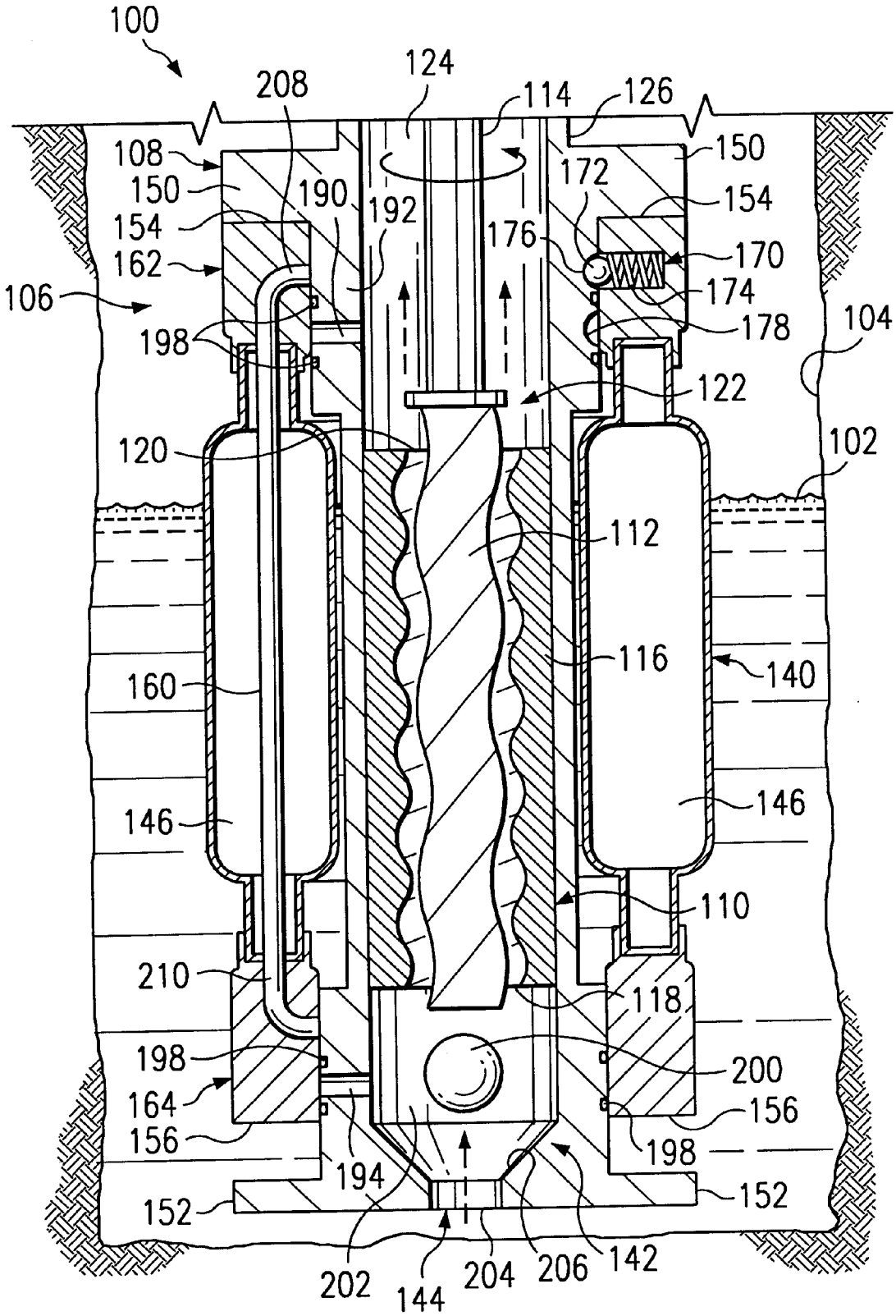
FIG. 2 is a diagram illustrating a fluid controlled pumping system in accordance with another embodiment of the present invention.
Figure 3:
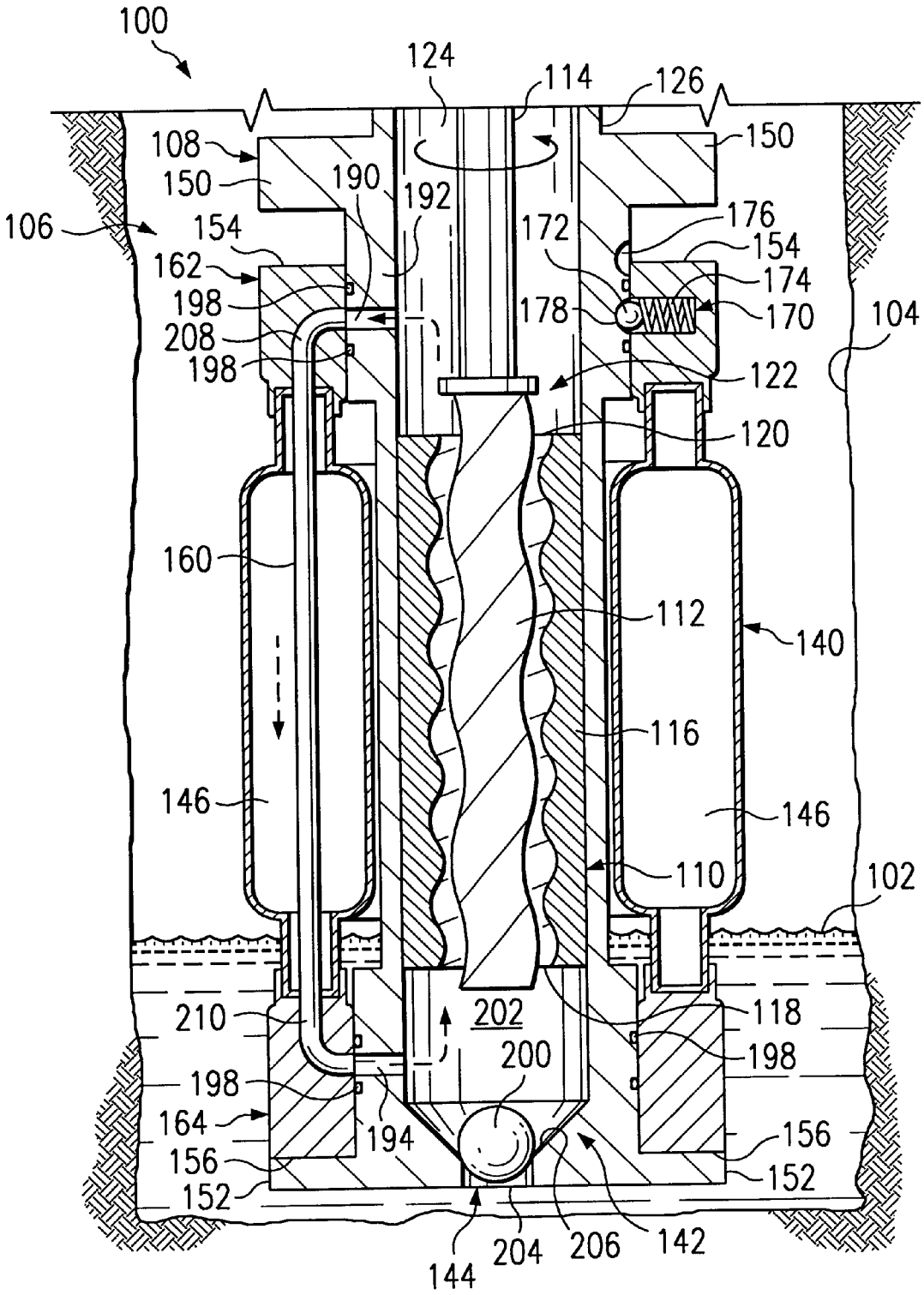
FIG. 3 is a diagram illustrating the fluid controlled pumping system illustrated in FIG. 2 after a change in a fluid level within a fluid cavity in accordance with an embodiment of the present invention.

FIG. 2 is a diagram illustrating a fluid controlled pumping system 100 in accordance with another embodiment of the present invention, and FIG. 3 is a diagram illustrating the system 100 illustrated in FIG. 2 after a decrease in a fluid 102 level within a well bore 104 in accordance with an embodiment of the present invention. In this embodiment, system 100 includes a pumping unit 106 disposed within the well bore 104 for pumping the fluid 102 within the well bore 104 to the surface. The pumping unit 106 illustrated in FIGS. 2 and 3 comprises a progressive cavity pump 108. However, it should be understood that other types of pumping units 106 may also be used in accordance with the teachings of the present invention.

As described above in connection with FIG. 1, the progressive cavity pump 108 includes a stator/rotor portion 110 for lifting the fluid 102 within the well bore 104 to the surface. For example, as illustrated in FIGS. 2 and 3, the stator/rotor portion 110 includes a rotor 112 coupled to a drive shaft 114 rotatable within a stator 116 of the pump 108. Thus, rotation of the rotor 112 relative to the stator 116 draws the fluid 102 into an inlet 118 of the stator/rotor portion 110 such that the corkscrew-like movement of the rotor 112 relative to the stator 116 lifts the fluid 102 through the stator/rotor portion 110 and dispels the fluid 102 outwardly from an outlet 120 of the stator/rotor portion 110. The fluid 102 then travels upwardly from a discharge end 122 of the stator/rotor portion 110 via an annulus 124 formed between the drive shaft 114 and a housing 126 of the pumping unit 106 to the surface.

In this embodiment, system 100 also includes a valve 140 disposed about the housing 126 of the pumping unit 106 and a check valve 142 disposed proximate a suction end 144 of the pumping unit 106. Valve 140 is slidably coupled to the housing 126 of the pumping unit 106 such that variations in the fluid 102 level within the well bore 104 cause corresponding upward and downward movement of the valve 140 relative to the pumping unit 106. For example, in this embodiment, valve 140 includes internal chambers 146 that may be filled with a fluid, foam, or other substance generally having a density less than a density of the fluid 102 such that the valve 140 floats in the fluid 102 relative to the pumping unit 106. Thus, for example, the internal chambers 146 may be filled with nitrogen, carbon dioxide, foam, or other suitable fluids or substances generally having a density less than a density of the fluid 102. In the embodiment illustrated in FIGS. 2 and 3, two internal chambers 146 are illustrated; however, it should be understood that a fewer or greater number of internal chambers 146 may be used to obtain floatation of the valve 140 relative to the pumping unit 106. The valve 140 may be constructed from two or more components secured together about the pumping unit 106, or the valve 140 may be constructed as a one-piece unit. For example, the check valve 142 may be removable coupled to the housing 126 (not explicitly shown) to accommodate placement of the valve 140 about the pumping unit 106. However, it should be understood that other suitable assembly methods may be used to position the valve 140 relative to the pumping unit 106.

In the embodiment illustrated in FIGS. 2 and 3, housing 126 includes integrally formed upper stops 150 and lower stops 152. Stops 150 and 152 restrict upward and downward movement of the valve 140 to predetermined locations relative to the pumping unit 106 in response to variations in the fluid 102 level within the well bore 104. For example, as illustrated in FIG. 2, as the level of the fluid 102 within the well bore 104 increases, the valve 140 floats upwardly relative to the pumping unit 106 until an upper end 154 of the valve 140 reaches the stop 150. Similarly, referring to FIG. 3, in response to a decrease in the level of the fluid 102 within the well bore 104, the valve 140 floats downwardly relative to the pumping unit 106 until a lower end 156 of the valve 140 reaches stops 152. Thus, as will be described in greater detail below, stops 150 and 152 are positioned on pumping unit 106 to position the valve 140 relative to the pumping unit 106 in predetermined locations to facilitate recirculation of the pumped fluid 102.

As illustrated in FIGS. 2 and 3, the valve 140 includes a passage 160 extending from an upper end 162 of the valve 140 to a lower end 164 of the valve 140. The passage 160 provides a communication path for recirculating all or a portion of the pumped fluid 102 from the discharge end 122 of the stator/rotor portion 110 to the inlet 118 of the stator/rotor portion 110 in response to a decreasing fluid 102 level within the well bore 104. The recirculation of the pumped fluid 102 will be described in greater detail below in connection with FIG. 3.

System 100 also includes a locking system 170 for releasably securing the valve 140 in predetermined positions relative to the pumping unit 106. In this embodiment, the locking system 170 includes a locking element 172 biased inwardly relative to the valve 140 towards the housing 126 via a spring 174. The housing 126 includes integrally formed recesses 176 and 178 configured to receive the locking element 172 to releasably secure the valve 140 in the predetermined positions relative to.the pumping unit 106. For example, as illustrated in FIG. 2, in response to an increase in the level of fluid 102 within the well bore 104, the valve 140 floats upwardly relative to the pumping unit 106 to an upwardly disposed position where the locking system 170 releasably secures the valve 140. As will be described in greater detail below, the locking system 170 substantially prevents undesired movement of the valve 140 relative to the pumping unit 106 as a result of fluid 102 turbulence within the well bore 104 or minor fluid 102 variations within the well bore 104. The locking system 170 also provides a mechanism for securing the valve 140 in a desired position relative to the pumping unit 106 to substantially reduce the power required for operating the pumping unit 106.

As illustrated in FIG. 3, in response to a decrease in the level of fluid 102 in the well bore 104, the valve 140 moves downwardly relative to the pumping unit 106 to a downwardly disposed position where locking system 170 releasably secures the valve 140. The locking system 170 may be configured such that a weight of the valve 140 unsupported by the fluid 102 is greater than a force of the spring 174 directed inwardly, thereby causing a release of the valve 140 from the upwardly disposed position in response to a decrease in the level of fluid 102 within the well bore 104. Thus, as will be described in greater detail below, the locking system 170 releasably secures the valve 140 in predetermined positions relative to the pumping unit 106 to facilitate recirculation of the pumped fluid 102 or to cease the recirculation of the pumped fluid 102.

As illustrated in FIGS. 2 and 3, the pumping unit 106 includes a port 190 formed in a wall 192 of the housing 126 proximate to the discharge end 122 of the stator/rotor portion 110. The pumping unit 106 also includes a port 194 formed in the wall 192 of the housing 126 proximate to the inlet 118 of the stator/rotor portion 110. Seals 198, such as O-ring elastomer seals or other suitable sealing members, are disposed on each side of ports 190 and 194 to prevent undesired leakage of the fluid 102 about the ports 190 and 194 relative to the valve 140.

The check valve 142 includes a ball or sphere 200 disposed within an internal area 202 of the check valve 142 sized greater than a size of an inlet 204 of the check valve 142 such that the sphere 200 may be received by a seating area 206 of the check valve 142 to substantially prevent passage of the fluid 102 through the inlet 204 from the internal area 202. However, it should be understood that other suitable shapes, such as ovoid or otherwise, or devices, such as a flapper or otherwise, may be used to substantially prevent passage of the fluid 102 through the inlet 204 from the internal area 202. As will be described in greater detail below, the check valve 142 is disposed proximate the inlet 118 of the stator/rotor portion 110 of the pumping unit 106 to direct the recirculated fluid 102 to the inlet 118.

In operation, a generally high level, or an increase in the level, of the fluid 102 within the well bore 104 causes upward movement of the valve 140 relative to the pumping unit 106, as illustrated in FIG. 2. The locking system 170 releasably secures the valve 140 in the upwardly disposed position such that the passage 160 of the valve 140 is misaligned with the ports 190 and 194, thereby preventing recirculation of the fluid 102 discharged from the outlet 120 of the stator/rotor portion 110. Thus, in operation, rotation of the rotor 112 relative to the stator 116 draws the fluid 102 inwardly through inlet 204 of the check valve 142 and into the internal area 202 of the check valve 142. The fluid 102 is further drawn into the inlet 118 of the stator/rotor portion 110 and is discharged from the outlet 120 as described above. In the upwardly disposed position, the passage 160 of the valve 140 is not in alignment with the port 190, thereby allowing the pumped fluid 102 to travel upwardly to the surface via the annulus 124. The locking system 170 releasably secures the valve 140 in the upwardly disposed position to prevent undesired movement of the valve 140 in response to minor fluctuations or turbulence in the level of fluid 102 within the well bore 104. Additionally, the stops 150 prevent extended upward movement of the valve 140 and accommodate engagement of the locking system 170.

As the level of the fluid 102 in the well bore 104 decreases, as illustrated in FIG. 3, the valve 140 travels downwardly relative to the pumping unit 106 where the locking system 170 releasably secures the valve 140 in the downwardly disposed position. In the valve 140 position illustrated in FIG. 3, an inlet 208 of the passage 160 is aligned with the port 190, thereby receiving all or a portion of the pumped fluid 102 from the discharge end 122 of the stator/rotor portion 110 into the passage 160. Additionally, in the downwardly disposed valve 140 position illustrated in FIG. 3, an outlet 210 of the passage 160 is aligned with the port 194, thereby communicating the fluid within the passage 160 into the internal area 202 of the check valve 142 and inlet 118.

As illustrated in FIG. 3, the reduced flow rate of the fluid 102 upwardly to the surface causes the sphere 200 to move downwardly and seat against the seating area 206 of the check valve 142, thereby substantially preventing the recirculated fluid 102 received through the port 194 from exiting the inlet 204. The locking system 170, therefore, provides positive positioning of the valve 140 in either an open or closed position to provide or cease, respectively, fluid 102 recirculation and substantially reduce or eliminate modulation of the valve 140 relative to the pumping unit 106. Additionally, the locking system 170 substantially reduces the power required to operate the pumping unit 106, for example, the power required to rotate the rotor 112, by releasably securing the valve 140 in a fully open position, thereby resulting in recirculation of the fluid 102.

Thus, in response to a decrease in the level of the fluid 102 within the well bore 104, the valve 140 moves downwardly relative to the pumping unit 106 to recirculate all or a portion of the pumped fluid 102 from the discharge end 122 of the stator/rotor portion 110 back to the inlet 118 of the stator/rotor portion 110, thereby providing a continuous loop of fluid 102 flow to the inlet 118 to substantially prevent operation of the pumping unit 106 in a "dry" or unlubricated condition. The passage 160 of the valve 140 provides a fluid communication path between the discharge end 122 and the inlet 118 in the downwardly disposed position illustrated in FIG. 3, thereby recirculating the pumped fluid 102 to the inlet 118 of the stator/rotor portion 110 in response to decreasing fluid 102 levels within the well bore 104. The passage 160 and ports 190 and 194 may be sized to recirculate all or a portion of the fluid 102.

Similarly, as the fluid 102 level within the well bore 104 increases, the valve 140 travels upwardly relative to the pumping unit 12 to the upwardly disposed position illustrated in FIG. 2. As described above, the locking system 170 may be configured such that the increasing fluid 102 level within the well bore 104 causes the valve 140 to create an upwardly directed force greater than the normal inwardly directed force from the spring 174, thereby releasing the valve 140 from the downwardly disposed position. As the valve 140 travels or floats upwardly relative to the pumping unit 106, the passage 160 becomes misaligned from the ports 190 and 192, thereby ceasing the recirculation of the fluid 102 to the inlet 118. The seals 198 substantially prevent any undesired fluid 102 flow through the ports 190 and 192. Thus, upward directed movement of the valve 140 relative to the pumping unit 106 redirects the pumped fluid 102 upwardly to the surface.

Thus, the present invention provides a fluid level controlled pumping system that automatically recirculates pumped fluid 102 to the inlet 118 of the pumping unit 106 in response to variations in the level of fluid 102 within the well bore 104. Therefore, the present invention provides greater reliability than prior pumping systems by maintaining lubrication of the pumping apparatus during decreased fluid levels within a well bore, thereby increasing the longevity of the pumping apparatus. Additionally, the present invention operates independently of manual intervention by an operator or user, thereby providing increased reliability and ease of use.

Figure 4:
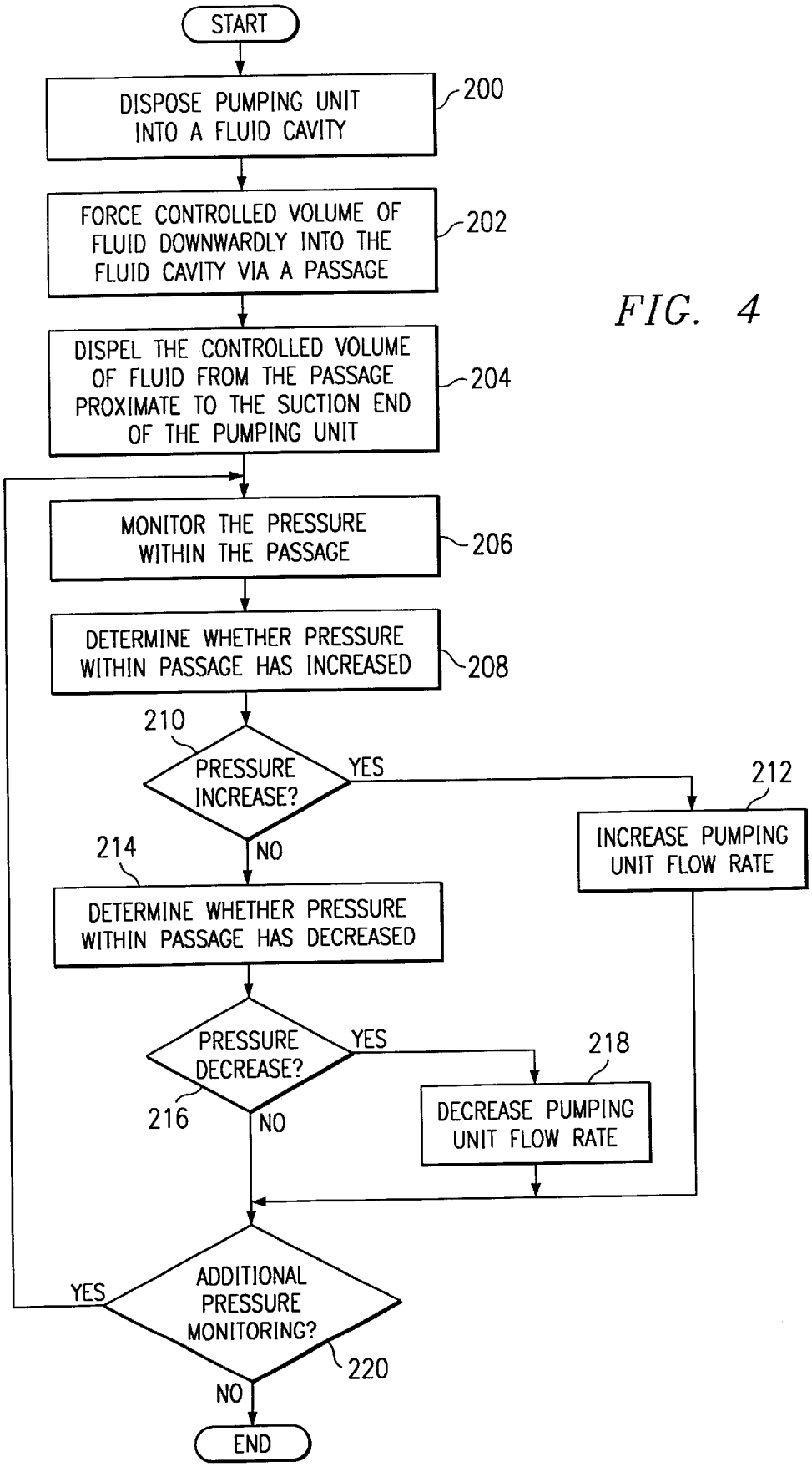
FIG. 4 is a flow chart illustrating a method for fluid level controlled pumping in accordance with an embodiment of the present invention.

FIG. 4 is a flowchart illustrating a method for fluid level controlled pumping in accordance with an embodiment of the present invention. The method begins at step 200, where the pumping unit 12 is disposed within the well bore 16. As described above, the pumping unit 12 may comprise a progressive cavity pump 18 or other suitable type of pumping unit. At step 202, the pressure source 72 is used to force a controlled volume of fluid downwardly into the well bore via the passage 60. As described above, in the progressive cavity pump 18 illustrated in FIG. 1, the pressurized fluid is forced downwardly through the rotor 30 via the passage 60. However, the passage 60 may be otherwise located or configured relative to the pumping unit 12 such that the end 62 of the passage 60 is disposed proximate to the suction end 34 of the pumping unit 12.

At step 204, the pressurized fluid is dispelled outwardly from the end 62 of the passage 60 proximate to the suction end 34 of the pumping unit 12. At step 206, the controller 76 monitors the pressure within the passage 60 via signals received from the sensor 74. As described above, the sensor 74 is coupled to the passage 60 and determines the fluid pressure within the passage 60 corresponding to the depth 64 of the fluid 32 within the well bore 16. At step 208, the controller 76 determines whether a pressure variation has occurred within the passage 60, thereby indicating a fluctuation in the level of the fluid 32 within the well bore 16. The controller 76 may include processing instructions and/or programming such that the pressure variations within the passage 60 must exceed a predetermined amount before a corresponding fluid 32 level fluctuation warrants a change in the operating parameters of the pumping unit 12. However, the controller 76 may otherwise be configured to automatically adjust the operating parameters of the pumping unit 12 based on the pressure variations within the passage 16.

At decisional step 210, a determination is made whether the pressure within the passage 60 has increased. If the pressure within the passage 60 has increased, the method proceeds from step 210 to step 212, where the controller 76 initiates an increase in the fluid 32 flow rate via the pumping unit 12. As described above, the controller 76 transmits a control signal to the drive motor 78 to regulate the operating parameters of the pumping unit 12 to obtain an increase in the pumping flow rate. If a pressure increase did not occur, the method proceeds from step 210 to step 214.

At decisional step 214, a determination is made whether the pressure within the passage 60 has decreased. If the pressure within the passage 60 has decreased, the method proceeds from step 216 to step 218, where the controller 76 initiates a decrease in the fluid 32 flow rate via the pumping unit 12. As described above, the controller 76 transmits a control signal to the drive motor 78 to decrease the flow rate of the fluid 32 pumped to the surface 14. If a pressure decrease did not occur within the passage 60, the method proceeds from step 216 to decisional step 220, where a determination is made whether additional monitoring of the pressure within the passage 60 is desired. If additional pressure monitoring is desired, the method returns to step 206. If no additional monitoring is desired, the method is complete.

Thus, the present invention provides an efficient fluid level controlled pumping system that substantially eliminates operation of a pumping unit in a "dry" or unlubricated condition, thereby increasing the operating life of the pumping unit. The present invention also provides a fluid level controlled pumping system that requires minimal manual operation and monitoring, thereby increasing the efficiency of pumping operations.

Although the present invention has been described in detail, various changes and modifications may be suggested to one skilled in the art. It is intended that the present invention encompass such changes and modifications as falling within the scope of the appended claims.

What is claimed is:

1. A fluid controlled pumping system, comprising:

a pumping unit disposed within a fluid cavity, the pumping unit having a passage extending to a suction end of the pumping unit;

a pressure sensor coupled to the passage and operable to determine a fluid pressure within the passage; and a controller coupled to the pumping unit and operable to regulate a fluid lubrication of the pumping unit in response to the fluid pressure, the regulation comprising decreasing a flow rate of the pumping unit in response to a decrease in the fluid pressure, and increasing a flow rate of the pumping unit in response to an increase in the fluid pressure.

2. The system of claim 1, wherein the pumping unit comprises a progressive cavity pump.

3. The system of claim 2, wherein the controller is operable to regulate the fluid lubrication of the pumping unit by regulating a rotational velocity of the progressive cavity pump.

4. The system of claim 3, wherein the controller is operable to regulate the fluid lubrication of the pumping unit by increasing the rotational velocity of the progressive cavity pump in response to an increase in the fluid pressure.

5. The system of claim 3, wherein the controller is operable to regulate the fluid lubrication of the pumping unit by decreasing the rotational velocity of the progressive cavity pump in response to a decrease in the fluid pressure.

6. The system of claim 1, wherein the fluid pressure within the passage corresponds to a fluid depth within the fluid cavity.

7. The system of claim 1, wherein the pumping unit comprises:

a stator; and a rotor disposed within the stator, the rotor operable to rotate relative to the stator to pump a fluid within the fluid cavity from a first location to a second location, and wherein the passage comprises an internal passage of the rotor.

8. The system of claim 7, wherein the pumping unit further comprises a motor coupled to the pumping unit and operable to impart a rotational force to the rotor, and wherein the controller is operable to transmit a control signal to the motor to regulate the rotational force.

9. The system of claim 5, wherein the controller is further operable to regulate a rotational velocity of the rotor to substantially prevent the rotor from rotating without fluid lubrication within the fluid cavity.

10. The system of claim 7, wherein the controller is operable to regulate the rotational velocity of the rotor to substantially prevent the rotor from rotating without fluid lubrication within the fluid cavity.

11. The system of claim 1, wherein the controller is operable to regulate the fluid lubrication of the pumping unit by regulating a flow rate of the pumping unit to maintain a substantially constant depth of a fluid within the fluid cavity.

12. The system of claim 1, further comprising a pressure source coupled to the passage and operable to force a fluid outwardly from the passage proximate to the suction end of the pumping unit.

13. The system of claim 12, wherein the pressure source comprises a pneumatic pressure source.

14. The system of claim 12, wherein the pressure source comprises compressed nitrogen.

15. A method for fluid controlled pumping, comprising:

providing a pumping unit disposed within a fluid cavity, the pumping unit having a passage extending to a suction end of the pumping unit;

forcing a fluid outwardly from the passage proximate to the suction end of the pumping unit;

determining a fluid pressure within the passage; and automatically regulating a fluid lubrication of the pumping unit in response to the fluid pressure, the regulation comprising decreasing a flow rate of the pumping unit in response to a decrease in the fluid pressure, and increasing a flow rate of the pumping unit in response to an increase in the fluid pressure.

16. The method of claim 15, wherein providing the pumping unit comprises providing a progressive cavity pump.

17. The method of claim 16, wherein regulating the fluid lubrication comprises regulating a rotational velocity of the progressive cavity pump.

18. The method of claim 17, wherein regulating the fluid lubrication comprises increasing the rotational velocity of the progressive cavity pump in response to an increase in the fluid pressure.

19. The method of claim 17, wherein regulating the fluid lubrication comprises decreasing the rotational velocity of the progressive cavity pump in response to a decrease in the fluid pressure.

20. The method of claim 17, wherein regulating comprises regulating the rotational velocity of the progressive cavity pump to substantially prevent the progressive cavity pump from rotating without fluid lubrication within the fluid cavity.

21. The method of claim 15, wherein determining the fluid pressure within the passage comprises determining a fluid depth within the fluid cavity.

22. The method of claim 15, wherein providing the pumping unit comprises providing a progressive cavity pump, the progressive cavity pump having a stator and a rotor, the rotor disposed within the stator, the rotor operable to rotate relative to the stator to pump a fluid within the fluid cavity from a first location to a second location, and wherein the passage comprises an internal passage of the rotor.

23. The method of claim 15, wherein forcing the fluid comprises forcing compressed air outwardly from the passage.

24. The method of claim 15, wherein forcing the fluid comprises forcing compressed nitrogen outwardly from the passage.

25. The method of claim 15, wherein regulating the fluid lubrication comprises regulating a flow rate of the pumping unit to maintain a substantially constant fluid level within the fluid cavity.

26. A method for fluid level controlled pumping, comprising:

providing a pumping unit within a cavity, the pumping unit having a suction end operable to draw a cavity fluid into the pumping unit for transfer of the cavity fluid from a first location to a second location;

determining a pressure proximate to the suction end of the pumping unit, the pressure corresponding to a depth of the cavity fluid within the cavity; and automatically regulating a fluid lubrication of the pumping unit by regulating a flow rate of the cavity fluid via the pumping unit using the determined pressure, wherein regulating the flow rate further comprises:

receiving a first signal from a pressure sensor indicating the pressure; and transmitting a second signal to a drive motor, the drive motor coupled to the pumping unit and operable to control the flow rate of the pumping unit.

27. The method of claim 26, wherein disposing the pumping unit comprises disposing a progressive cavity pump, and wherein regulating the flow rate comprises regulating a rotational velocity of a rotor of the progressive cavity pump using the determined pressure.

28. The method of claim 27, wherein determining the pressure comprises:

forcing a controlled volume of fluid.outwardly from a passage, the passage having an outlet proximate to the suction end of the pumping unit; and determining the pressure from within the passage.

29. The method of claim 28, wherein forcing the controlled volume of fluid comprises forcing the controlled volume of fluid downwardly within an internal passage of the rotor.

30. The method of claim 26, wherein providing the pumping unit comprises providing a progressive cavity pump, and wherein transmitting the second signal comprises transmitting the second signal to the drive motor to control a rotational velocity of a rotor of he progressive cavity pump.

31. A fluid level controlled pumping system, comprising:

a pumping unit disposed within a cavity, the pumping unit having a suction end operable to draw a cavity fluid into the pumping unit for transfer of the cavity fluid from a first location to a second location;

a pressure sensor operable to determine a pressure proximate to the suction end of the pumping unit, the pressure corresponding to a depth of the cavity fluid within the cavity; and a controller coupled to the pumping unit and operable to regulate a fluid lubrication of the pumping unit by regulating a flow rate of the cavity fluid via the pumping unit in response to the determined pressure, wherein the controller is operable to:

receive a first signal from a pressure sensor indicating the pressure; and transmit a second signal to a drive motor, the drive motor coupled to the pumping unit and operable to control the flow rate of the pumping unit.

32. The system of claim 31, wherein the pumping unit comprises a progressive cavity pump, and wherein the controller regulates the flow rate by regulating a rotational velocity of a rotor of the progressive cavity pump in response to the determined pressure.

33. The system of claim 32, wherein the controller is operable to control a pressure source to force a controlled volume of fluid outwardly from a passage, the passage having an outlet proximate to the suction end of the pumping unit, and wherein the pressure sensor is operable to determine the pressure from within the passage.

34. The system of claim 33, wherein the controller is operable to control a pressure source to force the controlled volume of fluid downwardly within an internal passage of the rotor.

35. The system of claim 31, wherein the pumping unit comprises a progressive cavity pump, and wherein the controller is operable to transmit the second signal to the drive motor to control a rotational velocity of a rotor of the progressive cavity pump.

* * * * *